US007480478B2

(12) United States Patent
Aze et al.

(10) Patent No.: US 7,480,478 B2
(45) Date of Patent: Jan. 20, 2009

(54) METHOD AND APPARATUS FOR IMAGE FORMING CAPABLE OF EFFECTIVELY FIXING A TONER IMAGE ON A RECORDING SHEET BY USING INDUCTION HEATING

(75) Inventors: Norihiko Aze, Zama (JP); Motokazu Hasegawa, Atsugi (JP); Eiji Sawamura, Yokohama (JP); Takayuki Yoshii, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 185 days.

(21) Appl. No.: 11/167,845

(22) Filed: Jun. 28, 2005

(65) Prior Publication Data

US 2005/0286938 A1 Dec. 29, 2005

(30) Foreign Application Priority Data

Jun. 28, 2004 (JP) ..... 2004-189072
Aug. 6, 2004 (JP) ..... 2004-230118
Apr. 14, 2005 (JP) ..... 2005-116658

(51) Int. Cl.
*G03G 15/20* (2006.01)
*H05B 6/14* (2006.01)

(52) U.S. Cl. ..... 399/328; 219/619

(58) Field of Classification Search ..... 219/216, 219/619; 399/328, 329, 330, 331
See application file for complete search history.

(56) References Cited

U.S. PATENT DOCUMENTS 5,400,123 A 3/1995 Sato et al.
5,426,495 A 6/1995 Sawamura et al.
5,602,651 A 2/1997 Tabata et al.
5,717,843 A 2/1998 Tabata et al.
5,774,232 A 6/1998 Tabata et al.
5,913,095 A 6/1999 Takashima et al.

(Continued)

FOREIGN PATENT DOCUMENTS

JP 2000-162912 6/2000

(Continued)

OTHER PUBLICATIONS

U.S. Appl. No. 11/444,412, filed Jun. 1, 2006, Hasegawa et al.

(Continued)

*Primary Examiner*—Hoang Ngo
(74) *Attorney, Agent, or Firm*—Oblon, Spivak, McClelland, Maier & Neustadt, P.C.

(57) ABSTRACT

An image forming apparatus includes a fixing unit for fixing a toner image on a recording sheet. The fixing unit includes a fixing belt, a support roller, and a coil. The fixing belt rotates and applies heat on the recording sheet to fix the toner image on the recording sheet. The support roller rotates and supports the fixing belt. The coil has a loop-like or U-like shape and generates a magnetic flux to induce heat in the fixing belt and the support roller. The coil sandwiches the support roller and the fixing belt in a manner that the coil faces an outer circumferential surface of the support roller via the fixing belt and an inner circumferential surface of the support roller. The above configuration of the coil controls a surface temperature of the fixing belt.

49 Claims, 10 Drawing Sheets

U.S. PATENT DOCUMENTS

| | | | | |
|---|---|---|---|---|
| 5,999,789 | A | 12/1999 | Sawamura | |
| 6,287,246 | B1 | 9/2001 | Yoshii et al. | |
| 6,704,536 | B2 * | 3/2004 | Nakayama | 399/328 |
| 6,861,124 | B2 | 3/2005 | Kamiya et al. | |
| 2002/0190060 | A1 * | 12/2002 | Imai et al. | 219/619 |
| 2003/0235417 | A1 | 12/2003 | Aze et al. | |
| 2004/0129062 | A1 | 7/2004 | Aze et al. | |
| 2004/0224165 | A1 | 11/2004 | Kondoh et al. | |
| 2005/0286938 | A1 | 12/2005 | Aze et al. | |

FOREIGN PATENT DOCUMENTS

| | | |
|---|---|---|
| JP | 2000-214703 | 8/2000 |
| JP | 2000-214704 | 8/2000 |
| JP | 2001-013805 | 1/2001 |
| JP | 2002-040871 | 2/2002 |
| JP | 2002-082549 | 3/2002 |
| JP | 2002-351236 | 12/2002 |
| JP | 2002-352943 | 12/2002 |
| JP | 2003-215956 | 7/2003 |
| JP | 2004-004319 | 1/2004 |

OTHER PUBLICATIONS

U.S. Appl. No. 11/519,893, filed Sep. 13, 2006, Inoue et al.
U.S. Appl. No. 11/613,039, filed Dec. 19, 2006, Aze et al.

* cited by examiner

METHOD AND APPARATUS FOR IMAGE FORMING CAPABLE OF EFFECTIVELY FIXING A TONER IMAGE ON A RECORDING SHEET BY USING INDUCTION HEATING

CROSS-REFERENCE TO RELATED APPLICATIONS

The present application is based on and claims priority to Japanese patent applications No. 2004-189072 filed on Jun. 28, 2004, No. 2004-230118 filed on Aug. 6, 2004, and No. 2005-116658 filed on Apr. 14, 2005 in the Japan Patent Office, the entire contents of each of which are incorporated herein by reference.

BACKGROUND OF THE INVENTION

1. Field of the Invention

The present invention relates to a method and apparatus for image forming, and more particularly to a method and apparatus for image forming capable of effectively fixing a toner image on a recording sheet by using induction heating which can effectively and speedily control a temperature of a fixing member.

2. Description of the Background Art

Background image forming apparatuses, such as copiers and printers, include fixing units using an induction heating method. The induction heating method may shorten a time period required for the fixing units to become operable after the fixing units are powered on, and reduce energy consumption.

One example of the fixing units includes a fixing belt, a support roller, an auxiliary fixing roller, an induction heater, and a pressure roller. The fixing belt is laid across the support roller and the auxiliary fixing roller. The induction heater faces the support roller via the fixing belt. The pressure roller faces the auxiliary fixing roller via the fixing belt. The induction heater includes a coil and a core. The coil is wound around the core and extends in directions parallel to a surface of a recording sheet in conveyance and perpendicular to a conveyance direction of the recording sheet which is conveyed between the pressure roller and the auxiliary fixing roller.

A high-frequency alternating current is applied to the coil to generate a magnetic field around the coil. The magnetic field induces an eddy current near a surface of the support roller. Electrical resistance of the support roller generates Joule heat. The fixing belt is heated by the Joule heat via the support roller. The heated fixing belt heats and fixes a toner image on the recording sheet at a position where the pressure roller and the auxiliary fixing roller oppose to each other.

In the above fixing unit, it is possible to increase a surface temperature of the fixing belt to a target fixing temperature in a short time period without consuming much energy.

Another example of the fixing units includes a fixing belt and an induction heater including a core wound by a coil. The core is formed to sandwich the fixing belt. The core faces outer and inner circumferential surfaces of the fixing belt to effectively heat the fixing belt.

Yet another example of the fixing units includes a fixing roller with an induction heater including a core. The core is configured to heat the fixing roller. When a toner image on a small-size recording sheet is fixed, the recording sheet does not contact axis ends of the fixing roller, resulting in increased temperatures of the axis ends of the fixing roller. To solve this problem, Curie points of the core are adjusted. Curie points of the axis ends of the core are set to be lower than a Curie point of an axis center of the core.

In the above fixing units, however, a temperature of a part of the fixing belt or the fixing roller may overly increase when the image fixing is conducted a number of times in a consecutive manner relative to smaller-size recording sheets. Also, a temperature of the whole fixing belt or fixing roller may overly increase when the fixing unit accidentally stops operating due to paper jam.

SUMMARY OF THE INVENTION

This specification describes a novel image forming apparatus. In one aspect, the novel image forming apparatus includes an image forming unit configured to form a toner image on a recording sheet and a fixing unit configured to fix the toner image on the recording sheet. The fixing unit includes a coil configured to create a magnetic flux and a heat generator surrounded by the coil and configured to generate heat by the magnetic flux generated by the coil.

The coil may include at least one wire. The coil may be formed in a U-like shape. The heat generator may be placed in a gap of the coil. Otherwise, the coil may be formed in a loop-like shape or a loop shape and the heat generator may be placed inside a loop of the coil.

The coil may be configured to receive an alternating current.

The heat generator may include a heat generating layer having a Curie point not greater than 300 degrees centigrade. The heat generating layer may include a magnetic shunt alloy.

The heat generator may include a fixing member configured to melt the toner image. The fixing member may be formed in a belt shape and extended in an endless loop form. The coil may be arranged at a position to face outer and inner circumferential surfaces of the fixing member.

The image forming apparatus may further include a pressure roller, a support roller, and an auxiliary fixing roller. The pressure roller may be configured to apply pressure to the recording sheet conveyed. The support roller may be configured to support the fixing member at one end of the endless loop form. The auxiliary fixing roller may be configured to support the fixing member at another end of the endless loop form and to receive the pressure from the pressure roller via the recording sheet and the fixing member. The coil may be arranged at a position facing the inner circumferential surface of the fixing member via the support roller.

The fixing member may have a roller shape and contact the pressure roller. The coil may be arranged at a position facing the outer and inner circumferential surfaces of the fixing member.

The heat generator may include a heater configured to apply heat to the fixing member. The heater may be configured to support the fixing member at one end of the endless loop form.

The fixing member may be configured to be rotated. The coil may be configured to sequentially face different areas of the outer and inner circumferential surfaces of the fixing member when the fixing member is rotated. The fixing member may be configured to be stopped rotating for a predetermined time period upon a time the coil is started to generate the magnetic flux until a temperature of the fixing member reaches a predetermined temperature.

The image forming apparatus may further include at least one supplemental heat generator configured to generate heat.

The image forming apparatus may further include a heat generating plate configured to heat the fixing member. The support roller may include a supplemental heat generator configured to heat the fixing member. The fixing member may include a heat generating layer.

The heat generating layer of the fixing member may be configured to have a Curie point higher than that of the supplemental heat generator. The Curie point of the heat generating layer of the fixing member may be higher than a target fixing temperature. The Curie point of the supplemental heat generator of the support roller may be close to the target fixing temperature.

The image forming apparatus may further include a supplemental coil configured to supplementally environ the outer and inner circumferential surfaces of the fixing member and to be controlled to generate a magnetic flux during a power-on time of the apparatus. The supplemental heat generator may be configured to be controlled to generate a magnetic flux after the power-on time of the apparatus.

This specification describes a novel image forming method. In another aspect, the novel image forming method includes the steps of forming a toner image on a recording sheet and fixing the toner image on the recording sheet. The fixing step includes the sub-step of creating a magnetic flux by applying an alternating current to a coil surrounding a heat generator to heat the heat generator by the magnetic flux to a predetermined temperature. The fixing step further includes the sub-step of consecutively rotating the heat generator to fix the toner image on the recording sheet by a portion of the heat generator having the predetermined temperature.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
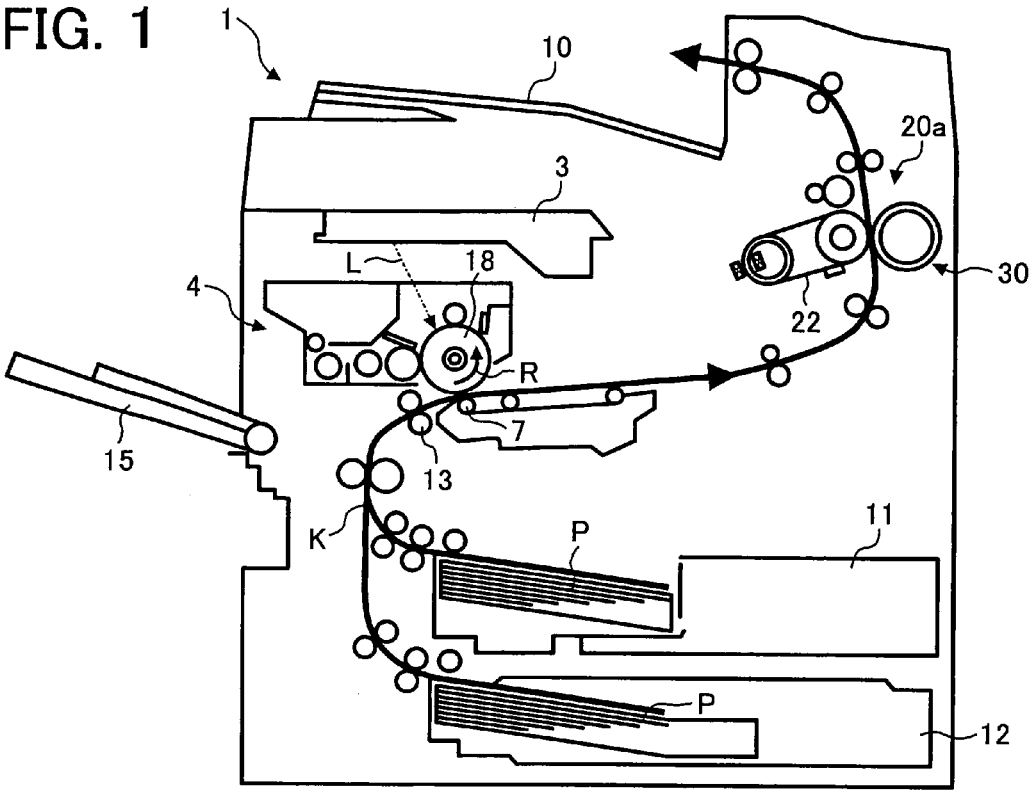
FIG. 1 is an illustration of an image forming apparatus according to an exemplary embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIG. 1, an image forming apparatus according to an exemplary embodiment of the present invention is explained.

As illustrated in FIG. 1, an image forming apparatus 1 includes an exposure unit 3, a process cartridge 4, paper trays 11 and 12, a bypass tray 15, a conveyance path K, a roller 13, a transferor 7, a fixing unit 20*a*, and an output tray 10.

The process cartridge 4 includes a photoconductive drum 18. The fixing unit 20*a* includes a fixing belt 22 and a pressure roller 30.

The image forming apparatus 1 is configured to function as a laser printer. The exposure unit 3 is configured to irradiate a light L onto the photoconductive drum 18 to form an electrostatic latent image. The photoconductive drum 18 is configured to carry the electrostatic latent image. The process cartridge 4 is configured to be attachable and detachable to and from the image forming apparatus 1 and visualize the electrostatic latent image formed on the photoconductive drum 18 to form a toner image. The paper trays 11 and 12 are configured to load recording sheets P. The bypass tray 15 is configured to load the recording sheets P. The conveyance path K is configured to convey the recording sheet P. The roller 13 is configured to feed the recording sheet P to the transferor 7. The transferor 7 is configured to transfer the toner image formed on the photoconductive drum 18 onto the recording sheet P. The fixing unit 20*a* is configured to fix the toner image on the recording sheet P. The fixing belt 22 is configured to apply heat to the recording sheet P to fix the toner image on the recording sheet P. The pressure roller 30 is configured to apply pressure to the recording sheet P to fix the toner image on the recording sheet P. The output tray 10 is configured to receive the recording sheet P having the fixed toner image.

The photoconductive drum 18 rotates in a rotating direction R. The exposure unit 3 irradiates the light L such as a laser beam onto the photoconductive drum 18 based on image information to form an electrostatic latent image on the photoconductive drum 18. In the process cartridge 4, the electrostatic latent image is developed with toner to form a toner image on the photoconductive drum 18. The transferor 7 transfers the toner image onto the recording sheet P fed by the roller 13.

Any one of the paper tray 11, the paper tray 12, and the bypass tray 15 is automatically or manually selected. When the paper tray 11 is selected, for example, an uppermost sheet of the recording sheets P loaded in the paper tray 11 is conveyed toward the conveyance path K. The recording sheet P is conveyed through the conveyance path K to the roller 13. The recording sheet P is further conveyed to the transferor 7 at timing when the toner image formed on the photoconductive drum 18 is properly transferred onto the recording sheet P.

The recording sheet P is conveyed to the fixing unit 20*a*. In the fixing unit 20*a*, the recording sheet P is sandwiched between the fixing belt 22 and the pressure roller 30. The fixing belt 22 applies heat to the recording sheet P. The pressure roller 30 applies pressure to the recording sheet P. The heat and pressure fix the toner image on the recording sheet P. The recording sheet P is output onto the output tray 10.

Figure 2:
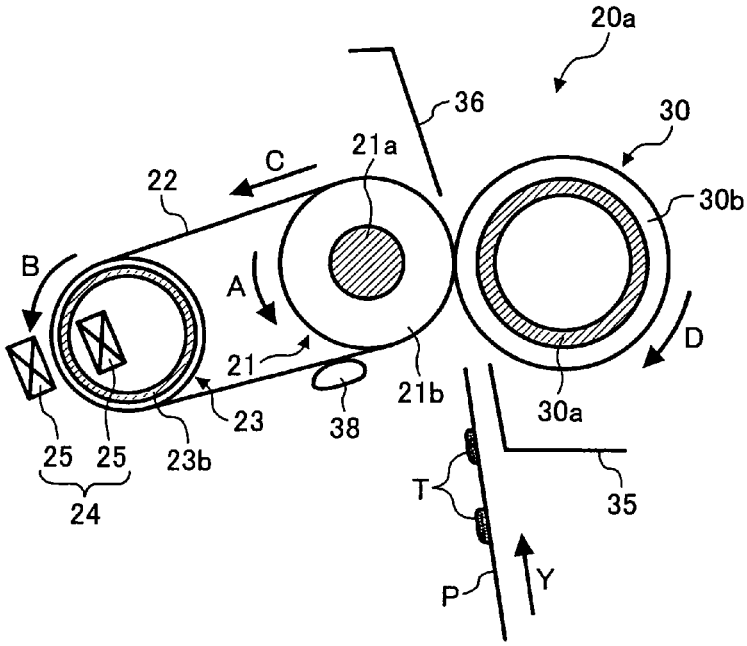
FIG. 2 is a cross-sectional view of a fixing unit of the image forming apparatus shown in FIG. 1.

As illustrated in FIG. 2, the fixing unit 20*a* further includes an auxiliary fixing roller 21, a support roller 23, an induction heater 24, a thermistor 38, a guide board 35, and a separation board 36.

The induction heater 24 includes a coil 25. The auxiliary fixing roller 21 includes a core 21*a* and an elastic layer 21*b*. The support roller 23 includes a heat generating layer 23*b*. The pressure roller 30 includes a cylinder 30*a* and an elastic layer 30*b*.

The auxiliary fixing roller 21 is configured to support and rotate the fixing belt 22. The support roller 23 is configured to support, rotate, and heat the fixing belt 22. The induction heater 24 is configured to generate a magnetic field. The thermistor 38 is configured to detect a surface temperature of the fixing belt 22. The guide board 35 is configured to guide the recording sheet P to the fixing belt 22. The separation board 36 is configured to guide the recording sheet P and help the recording sheet P separate from the fixing belt 22.

The coil 25 is configured to generate a magnetic flux. The core 21*a* is configured to be formed under the elastic layer 21*b*. The elastic layer 21*b* is configured to be formed on a surface of the core 21*a*. The heat generating layer 23*b* is configured to generate heat by the magnetic flux generated by the coil 25. The cylinder 30*a* is configured to be formed under the elastic layer 30*b*. The elastic layer 30*b* is configured to be formed on the cylinder 30*a*.

The core 21*a* includes stainless steel. The elastic layer 21*b* includes silicone rubber. The elastic layer 21*b* has a thickness of 3 mm to 10 mm and an asker hardness of 10 to 50 degrees. A driver (not shown) drives and rotates the auxiliary fixing roller 21 in a rotating direction A.

The heat generating layer 23*b* has a cylindrical shape and includes a magnetic, conductive material. The magnetic, conductive material includes nickel, metal, chrome, and an alloy of those, for example. The heat generating layer 23*b* has a thickness of approximately 0.6 mm. The support roller 23 rotates in a rotating direction B. The coil 25 sandwiches the support roller 23 in a manner that the coil 25 faces an outer circumferential surface of the support roller 23 via the fixing belt 22 and an inner circumferential surface of the support roller 23.

The heat generating layer 23*b* includes a magnetic shunt alloy having a Curie point not lower than a fixing temperature and not greater than 300 degrees centigrade. Specifically, the magnetic shunt alloy includes an alloy of nickel, metal, and chrome. The preferred Curie point can be obtained by adjusting quantity of the materials and processing conditions. The heat generating layer 23*b* includes the magnetic, conductive material in which the Curie point is near the fixing temperature. Thus, heat generated by the heat generating layer 23*b* properly heats the support roller 23, without overheating the support roller 23.

According to the present embodiment, the support roller 23 includes the heat generating layer 23*b* only. However, the support roller 23 may include a reinforcing layer (not shown), an elastic layer (not shown), or an insulating layer (not shown) on the heat generating layer 23*b*.

The fixing belt 22 is laid across the support roller 23 and the auxiliary fixing roller 21 in a tensioned condition, in a manner that the support roller 23 and the auxiliary fixing roller 21 support the fixing belt 22.

The cylinder 30*a* includes aluminum or copper. The elastic layer 30*b* includes fluorocarbon rubber or silicone rubber. The elastic layer 30*b* has a thickness of 1 mm to 5 mm and an asker hardness of 20 to 50 degrees. The pressure roller 30 presses the auxiliary fixing roller 21 via the fixing belt 22. The recording sheet P is conveyed to a contact portion (i.e., a fixing nip) where the pressure roller 30 contacts the fixing belt 22.

At an entrance to the contact portion, the guide board 35 is arranged to guide the recording sheet P conveyed in a direction Y to the contact portion. At an exit from the contact portion, the separation board 36 is arranged to guide the recording sheet P and help the recording sheet P separate from the fixing belt 22.

The thermistor 38 contacts an outer circumferential surface of the fixing belt 22 at an upstream side of the contact portion. The thermistor 38 includes a temperature-sensitive element having increased thermal response. The thermistor 38 detects the surface temperature of the fixing belt 22 to adjust output of the magnetic flux from the coil 25.

Figure 3:
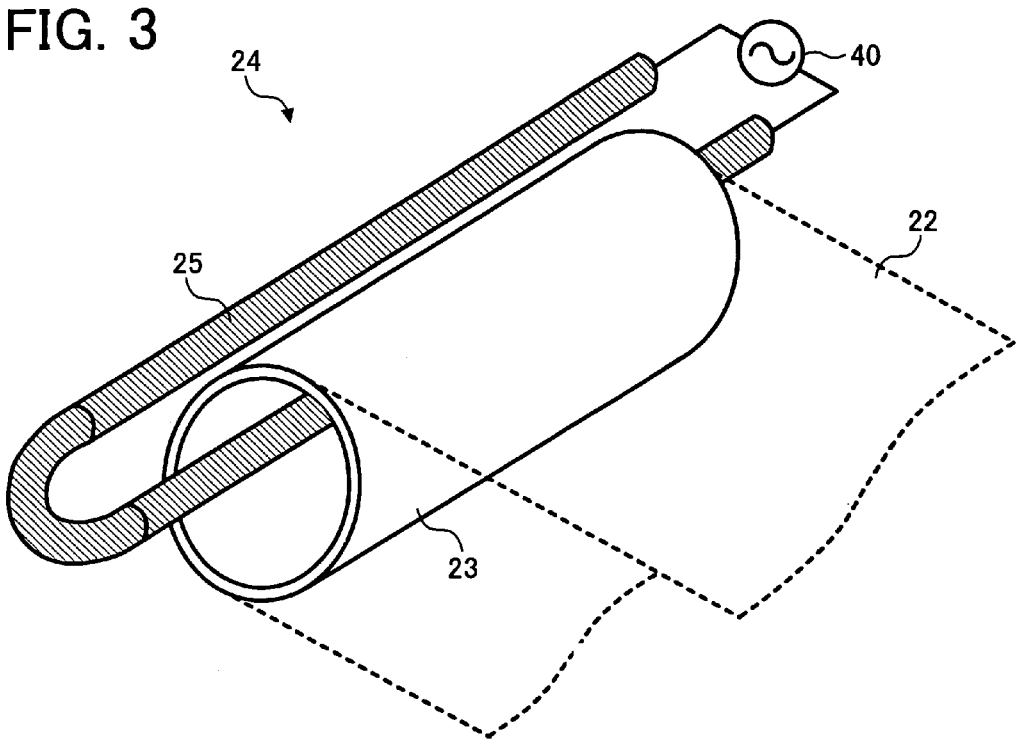
FIG. 3 is a perspective view of an induction heater of the fixing unit shown in FIG. 2.

As illustrated in FIG. 3, the induction heater 24 further includes a high-frequency power source 40.

The high-frequency power source 40 is configured to apply an alternating current to the coil 25.

The coil 25 includes an exciting coil having a U-like or loop-like shape. The coil 25 sandwiches the support roller 23 in the manner that the coil 25 faces the outer circumferential surface of the support roller 23 via the fixing belt 22 and the inner circumferential surface of the support roller 23. In other words, a part of the fixing belt 22 and the support roller 23 is placed inside the loop of the coil 25. The coil 25 is arranged in parallel with an axial direction of the fixing belt 22 and the support roller 23. One end of the coil 25 in the axial direction forms a loopback portion. The loopback portion connects a portion of the coil 25 that faces the inner circumferential surface of the support roller 23 and a portion of the coil 25 that faces the outer circumferential surface of the support roller 23 via the fixing belt 22. The other end of the coil 25 in the axial direction is connected with the high-frequency power source 40. The high-frequency power source 40 applies an alternating current of 10 kHz to 1 MHz, preferably 10 kHz to 300 kHz, to the coil 25.

According to the present embodiment, the coil 25 may include one exciting coil having the loop-like shape. The coil 25 may also include a plurality of exciting coils having the loop-like shape. The plurality of exciting coils may be arranged in a circumferential direction of the fixing belt 22 and the support roller 23. The coil 25 may include at least one wire. At least one wire wounds from the inner circumferential surface of the support roller 23 to the outer circumferential surface of the fixing belt 22 once or several times.

Figure 4A:
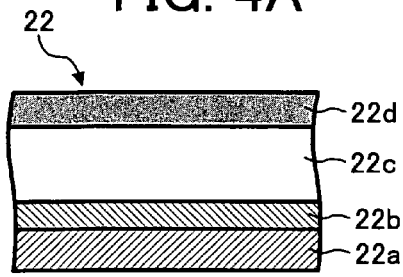
FIGS. 4A, 4B, 4C, and 4D are cross-sectional views of a fixing belt of the fixing unit shown in FIG. 2.

As illustrated in FIG. 4A, the fixing belt 22 includes a multi-layered, endless belt. The fixing belt 22 includes a base layer 22*a*, a heat generating layer 22*b*, an elastic layer 22*c*, and a releasing layer 22*d*.

The base layer 22*a* includes an insulative heat-resistant resin material. The insulative heat-resistant resin material includes polyimide, polyamide-imide, PEEK (polyetheretherketone), PES (polyethersulfone), PPS (polyphenylene sulfide), and a fluorocarbon resin, for example. The base layer 22*a* has a thickness of 30 μm to 200 μm, considering heat capacity and strength.

The heat generating layer 22*b* includes a magnetic, conductive material. The magnetic, conductive material includes nickel or stainless steel, for example. The heat generating layer 22*b* has a thickness of 1 μm to 20 μm. The heat generating layer 22*b* is formed on the base layer 22*a* by any one of plating, sputtering, and vacuum deposition. According to the present embodiment, the heat generating layer 22*b* includes a magnetic shunt alloy having the Curie point not lower than the fixing temperature and not greater than 300 degrees centigrade. Specifically, the magnetic shunt alloy includes an alloy of nickel, metal, and chrome. The preferred Curie point can be obtained by adjusting quantity of the materials and processing conditions. The heat generating layer 22*b* includes the magnetic, conductive material in which the Curie point is near the fixing temperature. Thus, heat generated by the heat generating layer 22*b* properly heats the fixing belt 22, without overheating the fixing belt 22.

The elastic layer 22*c* includes silicone rubber or fluorosilicone rubber. The elastic layer 22*c* has a thickness of 50 μm to 500 μm and an asker hardness of 5 to 50 degrees. Thus, the toner image transferred on the recording sheet P can be uniformly glossy.

The releasing layer 22*d* includes a fluorocarbon resin, a mixture of the fluorocarbon resins, or a heat-resistant resin in which the fluorocarbon resins are dispersed. The fluorocarbon resin includes PTFE (polytetrafluoroethylene), PFA (tetrafluoroethylene-perfluoroalkylvinylether copolymer resin), and FEP (tetrafluoroethylene-hexafluoropropylene copolymer resin). The releasing layer 22*d* has a thickness of 5 μm to 50 μm, preferably 10 μm to 30 μm. Thus, toner may be easily released from the fixing belt 22, and the fixing belt 22 may have flexibility. A primer layer (not shown) may be provided between the base layer 22*a* and the heat generating layer 22*b*, between the heat generating layer 22*b* and the elastic layer 22*c*, or between the elastic layer 22*c* and the releasing layer 22*d*.

Figure 4B:
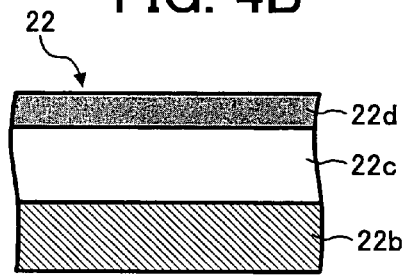
Figure 4C:
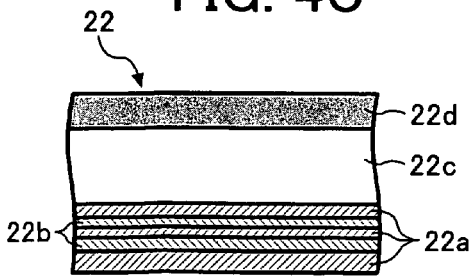
Figure 4D:
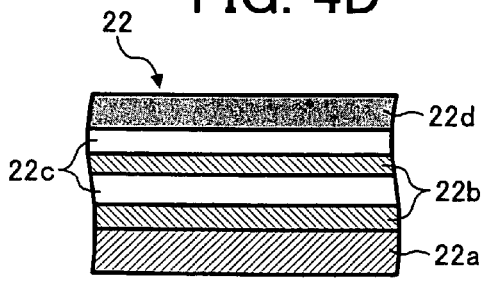

According to the present embodiment, the fixing belt 22 includes four layers as illustrated in FIG. 4A. However, the fixing belt 22 may include multiple layers as illustrated in FIGS. 4B, 4C, and 4D. The fixing belt 22 illustrated in FIG. 4B includes the heat generating layer 22*b*, the elastic layer 22*c*, and the releasing layer 22*d*. The heat generating layer 22*b* also includes a resin material in which magnetic, conductive particles are dispersed. The resin material includes polyimide, polyamide-imide, PEEK, PES, PPS, and a fluorocarbon resin, for example. In this case, quantity of the magnetic, conductive particles is in a range of 20 to 90 weight percent against quantity of the resin material. Specifically, a dispersing device (not shown) disperses the magnetic, conductive particles in the varnished resin material. The dispersing device includes a roll mill, a sand mill, and a centrifugal defoamer, for example. A solvent is added to properly adjust viscosity of the dispersed resin material. The resin material is put into a mold to form the heat generating layer 22*b* having the preferred thickness.

The fixing belt 22 illustrated in FIG. 4C includes the base layer 22*a*, the heat generating layers 22*b*, the elastic layer 22*c*, and the releasing layer 22*d*. The base layer 22*a* includes a plurality of the heat generating layers 22*b*. The releasing layer 22*d* and the elastic layer 22*c* are formed on the base layer 22*a*. The fixing belt 22 illustrated in FIG. 4D includes the base layer 22*a*, the heat generating layers 22*b*, the elastic layer 22*c*, and the releasing layer 22*d*. The elastic layer 22*c* includes a plurality of the heat generating layers 22*b*. The elastic layer 22*c* is formed on the base layer 22*a*. The releasing layer 22*d* is formed as a surface layer on the elastic layer 22*c*. The heat generating layers 22*b* illustrated in FIGS. 4B, 4C, and 4D may produce effects similar to the effects produced by the heat generating layer 22*b* illustrated in FIG. 4A.

Operations of a fixing process performed by the fixing unit 20*a* are explained below. The auxiliary fixing roller 21 rotates in the rotating direction A. The auxiliary fixing roller 21 drives and rotates the fixing belt 22 in a rotating direction C. Accordingly, the support roller 23 rotates in the rotating direction B and the pressure roller 30 rotates in a rotating direction D. Heat induced by the coil 25 heats the fixing belt 22 at a position where the coil 25 faces the fixing belt 22 (i.e., a face position).

Specifically, the high-frequency power source 40 applies a high-frequency alternating current of 10 kHz to 1 MHz to the coil 25. Magnetic lines of force are formed in the loop of the coil 25. Directions of the magnetic lines of force alternately switch in opposite directions to form an alternating magnetic field. When temperatures of the heat generating layers 22*b* and 23*b* are not greater than the Curie point, eddy currents generate in the heat generating layers 22*b* and 23*b*. Electric resistances of the heat generating layers 22*b* and 23*b* generate Joule heat. The Joule heat heats a portion on the surface of the fixing belt 22 at the face position. The portion faces the coil 25.

The heated surface of the fixing belt 22 passes the thermistor 38 and reaches the contact portion. The heated surface of the fixing belt 22 heats and fixes a toner image T on the conveyed recording sheet P. Specifically, the guide board 35 guides the recording sheet P having the toner image T, so that the recording sheet P conveyed in the direction Y is inserted between the fixing belt 22 and the pressure roller 30. Heat from the fixing belt 22 and pressure from the pressure roller 30 fix the toner image T on the recording sheet P. The recording sheet P is fed between the fixing belt 22 and the pressure roller 30.

After passing the contact portion, the portion on the surface of the fixing belt 22 reaches the face position again. The operations described above are repeated to complete the fixing process.

When temperatures of the heat generating layers 22*b* and 23*b* exceed the Curie point, the heat generating layers 22*b* and 23*b* generate less heat. Namely, the heat generating layers 22*b* and 23*b* lose their magnetic properties. Generation of the eddy currents is suppressed. Thus, generation of the Joule heat is suppressed to prevent the temperatures of the heat generating layers 22*b* and 23*b* from overly increasing.

The heat generating layers 22*b* and 23*b* control their temperatures more effectively when the coil 25 having the loop-like shape sandwiches the support roller 23 in the manner that the coil 25 faces the outer circumferential surface of the support roller 23 via the fixing belt 22 and the inner circumferential surface of the support roller 23 according to the present embodiment than when the coil 25 faces the outer circumferential surface of the support roller 23 via the fixing belt 22 only.

As described above, according to the present embodiment, the support roller 23 is surrounded by the coil 25 in the manner that the coil 25 faces the outer circumferential surface of the support roller 23 via the fixing belt 22 and the inner circumferential surface of the support roller 23. The Curie point of the heat generating layers 22*b* and 23*b* is set to be near the fixing temperature. Therefore, the heat generating layers 22*b* and 23*b* effectively control their temperatures. Even when the image fixing is conducted a number of times in a consecutive manner relative to the smaller-size recording sheets P or the fixing unit 20*a* accidentally stops operating, it is possible to prevent the surface temperature of the fixing belt 22 from overly increasing.

According to the present embodiment, the support roller 23 is used as a heater for heating the fixing belt 22. The heat generating layers 22*b* and 23*b* are used as heat generating layers for generating heat by the magnetic flux generated by the coil 25. The fixing belt 22 and the support roller 23 are used as heat generators including the heat generating layers. The fixing belt 22 is used as a fixing member for fixing a toner image on the recording sheet P.

However, only one of the fixing belt 22 and the support roller 23 may be used as the heat generator. In this case, the fixing belt 22 includes the heat generating layer 22*b*. The support roller 23 includes the heat generating layer 23*b*. The coil 25 has the loop-like shape and sandwiches the one of the fixing belt 22 and the support roller 23. Thus, effects similar to the effects according to the present embodiment can be obtained.

Figure 5:
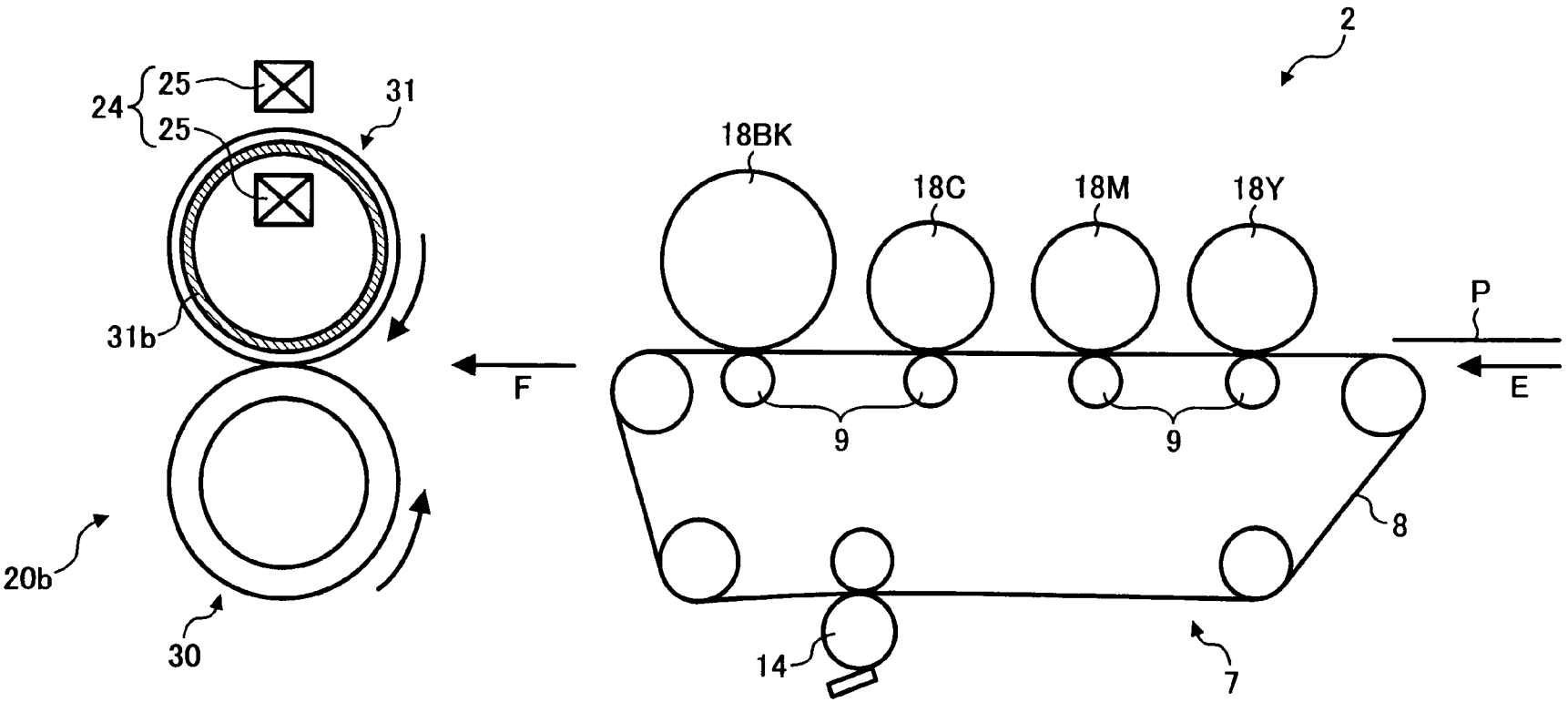
FIG. 5 is an illustration of an image forming apparatus according to another exemplary embodiment of the present invention.

Referring to FIG. 5, another exemplary embodiment of the present invention is explained.

An image forming apparatus 2 includes the transferor 7, photoconductive drums 18BK, 18C, 18M, and 18Y, and a fixing unit 20*b*.

The transferor 7 includes a transfer belt 8, bias rollers 9, and a cleaning roller 14. The fixing unit 20*b* includes the induction heater 24, the pressure roller 30, and a fixing roller 31.

The induction heater 24 includes the coil 25. The fixing roller 31 includes a heat generating layer 31*b*.

The image forming apparatus 2 is configured to be a tandem type color image forming apparatus. The photoconductive drum 18BK is configured to carry a toner image in black color. The photoconductive drum 18C is configured to carry a toner image in cyan color. The photoconductive drum 18M is configured to carry a toner image in magenta color. The photoconductive drum 18Y is configured to carry a toner image in yellow color.

The transfer belt 8 is configured to convey the recording sheet P. Each of the bias rollers 9 is configured to apply a transfer bias to the transfer belt 8 to transfer each of the toner images in the above four colors onto the recording sheet P to form a full-color toner image on the recording sheet P. The cleaning roller 14 is configured to clean a surface of the transfer belt 8. The fixing unit 20*b* is configured to fix the full-color toner image on the recording sheet P. The heat generating layer 31*b* is configured to generate heat by the magnetic flux generated by the coil 25. The fixing roller 31 is configured to apply the heat to the recording sheet P to fix the full-color toner image on the recording sheet P.

The image forming apparatus 2 further includes the process cartridge 4 illustrated in FIG. 1. The process cartridge 4 includes the photoconductive drums 18BK, 18C, 18M, and 18Y, a charger (not shown), an exposure unit (not shown), a development unit (not shown), a cleaning unit (not shown), and a discharger (not shown). The photoconductive drums 18BK, 18C, 18M, and 18Y are aligned on the transfer belt 8. Around each of the photoconductive drums 18BK, 18C, 18M, and 18Y, the charger, the exposure unit, the development unit, the cleaning unit, and the discharger are arranged.

The charger, the exposure unit, and the development unit respectively perform charging, exposure, and development processes to form a toner image in each of the black, cyan, magenta, and yellow colors on each of the photoconductive drums 18BK, 18C, 18M, and 18Y.

The transfer belt 8 conveys the recording sheet P fed in a direction E to the photoconductive drums 18Y, 18M, 18C, and 18BK. Each of the bias rollers 9 applies a transfer bias to the transfer belt 8 to transfer and superimpose each of the toner images in the yellow, magenta, cyan, and black colors respectively formed on the photoconductive drums 18Y, 18M, 18C, and 18BK onto the recording sheet P. Thus, a full-color toner image is formed on the recording sheet P. The recording sheet P having the full-color toner image separates from the transfer belt 8 and is conveyed to the fixing unit 20*b*.

The fixing roller 31 includes the heat generating layer 31*b*, an elastic layer (not shown), and a releasing layer (not shown). The heat generating layer 31*b* includes a magnetic, conductive material. The elastic layer includes silicone rubber. The releasing layer includes fluorochemical. The heat generating layer 31*b* includes a magnetic shunt alloy having the Curie point not lower than the fixing temperature and not greater than 300 degrees centigrade. The fixing roller 31 has a mechanical strength capable of resisting a pressure applied by the pressure roller 30.

The induction heater 24 includes the coil 25 having the loop-like shape. The coil 25 sandwiches the fixing roller 31 in a manner that the coil 25 faces outer and inner circumferential surfaces of the fixing roller 31. An alternating current of 10 kHz to 1 MHz is applied to the coil 25. Magnetic lines of force are formed in the loop of the coil 25. The magnetic lines of force induce an eddy current. Electric resistance of the heat generating layer 31*b* generates Joule heat. The Joule heat heats the fixing roller 31. The heated fixing roller 31 heats and fixes the full-color toner image on the recording sheet P conveyed in a direction F.

When a temperature of the heat generating layer 31*b* exceeds the Curie point, the heat generating layer 31*b* effectively controls its temperature.

As described above, according to the present embodiment, the fixing roller 31 is surrounded by the coil 25 in the manner that the coil 25 faces the outer and inner circumferential surfaces of the fixing roller 31. The Curie point of the heat generating layer 31*b* is set to be near the fixing temperature. Therefore, the heat generating layer 31*b* effectively controls its temperature. Even when the image fixing is conducted a number of times in a consecutive manner relative to the smaller-size recording sheets P or the fixing unit 20*b* accidentally stops operating, it is possible to prevent a temperature of the fixing roller 31 from overly increasing.

According to the present embodiment, the fixing roller 31 is used as the heater, the heat generator, and the fixing member. The heat generating layer 31*b* is used as the heat generating layer.

However, the fixing belt 22 instead of the fixing roller 31 may be used as the fixing member. In this case, the fixing belt 22 has a cylindrical shape. A holder (not shown) contacts a part of the inner circumferential surface of the fixing belt 22 to keep the cylindrical shape. A presser (not shown) contacts the inner circumferential surface of the fixing belt 22 at a position where the fixing belt 22 opposes to the pressure roller 30 to form a proper fixing nip between the fixing belt 22 and the pressure roller 30. The fixing belt 22 is surrounded by the coil 25 in the manner that the coil 25 faces outer and inner circumferential surfaces of the fixing belt 22. The Curie point of the heat generating layer 22*b* is set to be near the fixing temperature. Thus, effects similar to the effects according to the present embodiment can be obtained.

Figure 6:
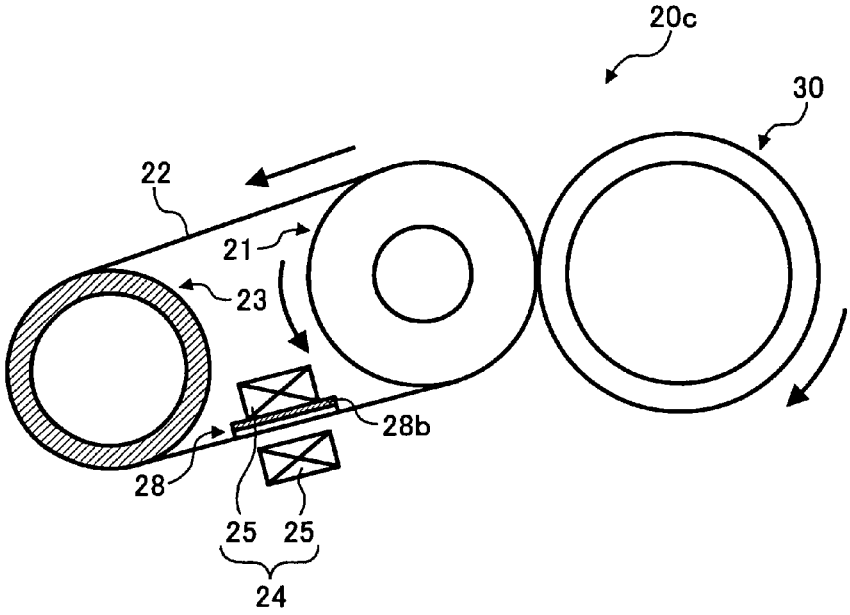
FIG. 6 is a cross-sectional view of a fixing unit according to another exemplary embodiment of the present invention.

Referring to FIG. 6, another exemplary embodiment of the present invention is explained.

A fixing unit 20*c* includes parts included in the fixing unit 20*a*, but further includes a heat generating plate 28. The heat generating plate 28 includes a heat generating layer 28*b*.

The fixing unit 20*c* is configured to fix a toner image on the recording sheet P. The heat generating plate 28 is configured to pressingly contact the inner circumferential surface of the fixing belt 22. The heat generating layer 28*b* is configured to generate heat by the magnetic flux generated by the coil 25.

The heat generating layer 28*b* includes a magnetic shunt alloy having the Curie point not lower than the fixing temperature and not greater than 300 degrees centigrade.

The induction heater 24 includes the coil 25 having the loop-like shape. The induction heater 24 is arranged between the auxiliary fixing roller 21 and the support roller 23. The coil 25 sandwiches the fixing belt 22 in a manner that the coil 25 faces the inner circumferential surface of the fixing belt 22 via the heat generating plate 28 and the outer circumferential surface of the fixing belt 22.

An alternating current of 10 kHz to 1 MHz is applied to the coil 25. Magnetic lines of force are formed in the loop of the coil 25. The magnetic lines of force induce eddy currents. Electric resistances of the heat generating layers 22*b* and 28*b* generate Joule heat. The Joule heat heats the fixing belt 22. When temperatures of the heat generating layers 22*b* and 28*b* exceed the Curie point, the heat generating layers 22*b* and 28*b* effectively control their temperatures.

As described above, according to the present embodiment, the fixing belt 22 is surrounded by the coil 25 in the manner that the coil 25 faces the inner circumferential surface of the fixing belt 22 via the heat generating plate 28 and the outer circumferential surface of the fixing belt 22. The Curie point of the heat generating layers 22*b* band 28*b* is set to be near the fixing temperature. Therefore, the heat generating layers 22*b* and 28*b* effectively control their temperatures. Even when the image fixing is conducted a number of times in a consecutive manner relative to the smaller-size recording sheets P or the fixing unit 20*c* accidentally stops operating, it is possible to prevent the surface temperature of the fixing belt 22 from overly increasing.

According to the present embodiment, the heat generating plate 28 is used as the heater. The heat generating layers 22*b* and 28*b* are used as the heat generating layers. The fixing belt 22 and the heat generating plate 28 are used as the heat generators. The fixing belt 22 is used as the fixing member.

However, one of the fixing belt 22 and the heat generating plate 28 may be used as the heat generator. In this case, effects similar to the effects according to the present embodiment can be obtained, if the fixing belt 22 and the heat generating plate 28 respectively include the heat generating layers 22*b* and 28*b*, and the coil 25 is arranged as described above. The heat generating plate 28 may be removed if the coil 25 properly sandwiches the fixing belt 22.

Referring to FIGS. 7A, 7B, 8A, 8B, 9A, and 9B, experiments verifying the above effects are explained.

Figure 7A:
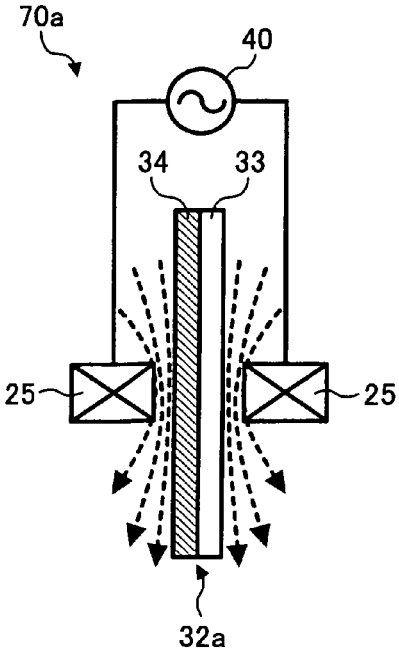
FIG. 7A is a schematic illustration of an experimental device.
Figure 7B:
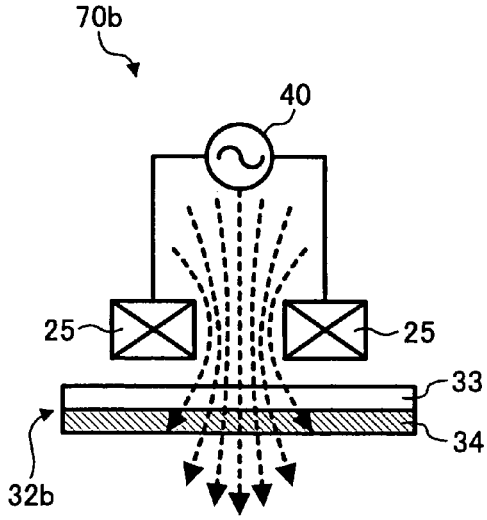
FIG. 7B is a schematic illustration of another experimental device.

FIGS. 7A and 7B illustrate experimental devices 70*a* and 70*b*. The experimental device 70*a* includes the coil 25, a test piece 32*a*, and the high-frequency power source 40. The experimental device 70*b* includes the coil 25, a test piece 32*b*, and the high-frequency power source 40. Each of the test pieces 32*a* and 32*b* includes a heat generating layer 33 and a conductive layer 34.

Each of the experimental devices 70*a* and 70*b* is configured to include an induction heater equivalent to the induction heater 24 and a heat generating layer equivalent to the heat generating layer 22*b*, 23*b*, 28*b*, or 31*b*. The test pieces 32*a* and 32*b* are configured to function as the heat generators. The heat generating layer 33 is configured to generate heat by the magnetic flux generated by the coil 25. The conductive layer 34 is configured to form a current-carrying portion.

As illustrated in FIG. 7A, the coil 25 sandwiches the test piece 32*a* in a manner that the coil 25 faces a front surface (i.e., the heat generating layer 33) and a back surface (i.e., the conductive layer 34) of the test piece 32*a*. The experimental device 70*a* has a structure of the fixing unit 20*a*, 20*b*, or 20*c*.

As illustrated in FIG. 7B, the coil 25 faces a front surface (i.e., the heat generating layer 33) of the text piece 32*b*. The experimental device 70*b* has a structure of a background fixing unit.

Figure 8A:
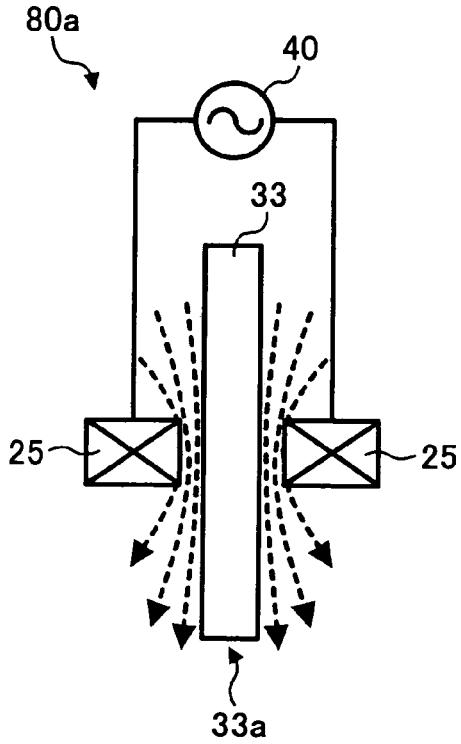
FIG. 8A is a schematic illustration of another experimental device.
Figure 8B:
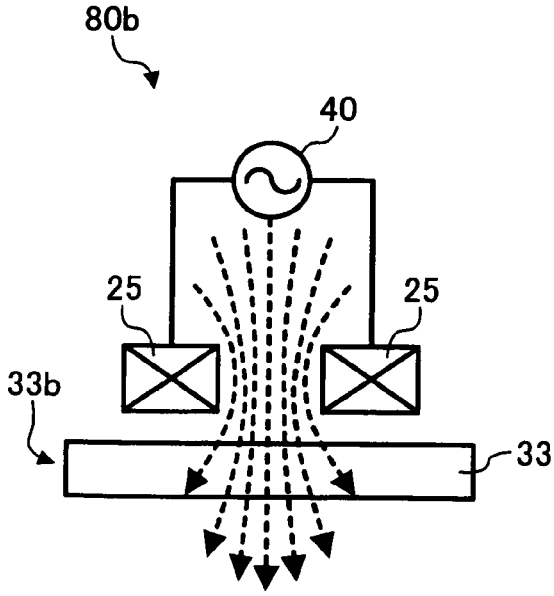
FIG. 8B is a schematic illustration of another experimental device.

FIGS. 8A and 8B illustrate experimental devices 80*a* and 80*b*. The experimental device 80*a* includes the coil 25, a test piece 33*a*, and the high-frequency power source 40. The experimental device 80*b* includes the coil 25, a test piece 33*b*, and the high-frequency power source 40.

The experimental devices 80*a* and 80*b* are configured to include an induction heater equivalent to the induction heater 24 and a heat generating layer equivalent to the heat generating layer 22*b*, 23*b*, 28*b*, or 31*b*. The test pieces 33*a* and 33*b* are configured to function as the heat generators.

As illustrated in FIG. 8A, the coil 25 sandwiches the test piece 33*a* in a manner that the coil 25 faces front and back surfaces (i.e., the heat generating layer 33) of the test piece 33*a*. The experimental device 80*a* has a structure of the fixing unit 20*a*, 20*b*, or 20*c*.

As illustrated in FIG. 8B, the coil 25 faces a front surface (i.e., the heat generating layer 33) of the test piece 33*b*. The experimental device 80*b* has a structure of another background fixing unit.

The heat generating layer 33 includes a magnetic shunt alloy having a Curie point of 240 degrees centigrade. The heat generating layer 33 has an area of 25 mm×50 mm and a thickness of 0.22 mm. The conductive layer 34 includes aluminum. The conductive layer 34 has an area of 25 mm×50 mm and a thickness of 0.3 mm or 0.8 mm.

The high-frequency power source 40 applies an alternating current having power of 200 W to 1,200 W and an exciting frequency of 36 kHz or 130 kHz to the coil 25. Thus, magnetic lines of force illustrated with broken line arrows in FIGS. 7A, 7B, 8A, and 8B generate near the coil 25.

Figure 9A:
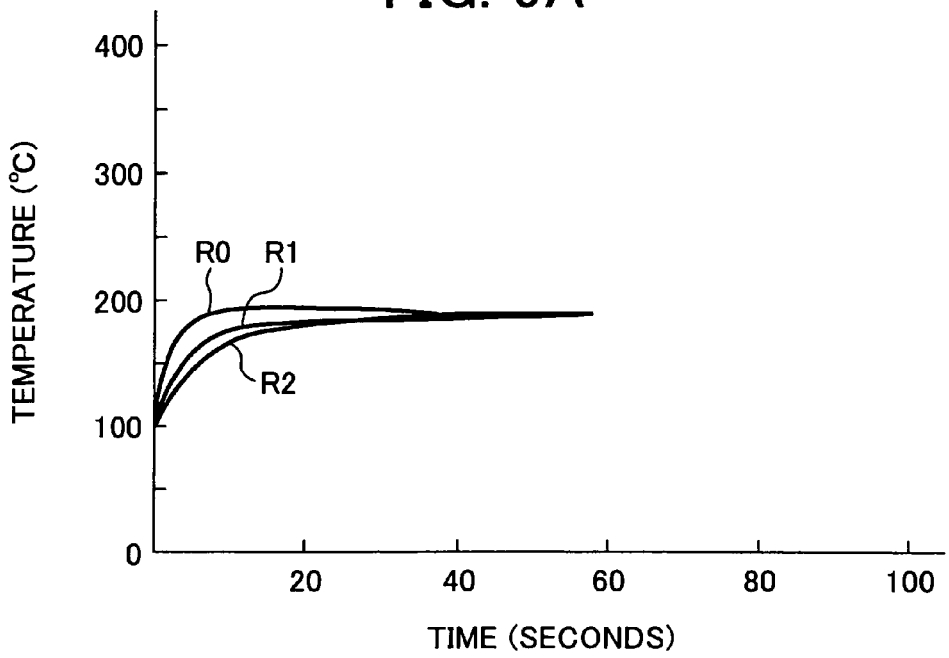
FIGS. 9A and 9B are graphs illustrating experimental results obtained by using the experimental devices of FIGS. 7A and 8A.
Figure 9B:
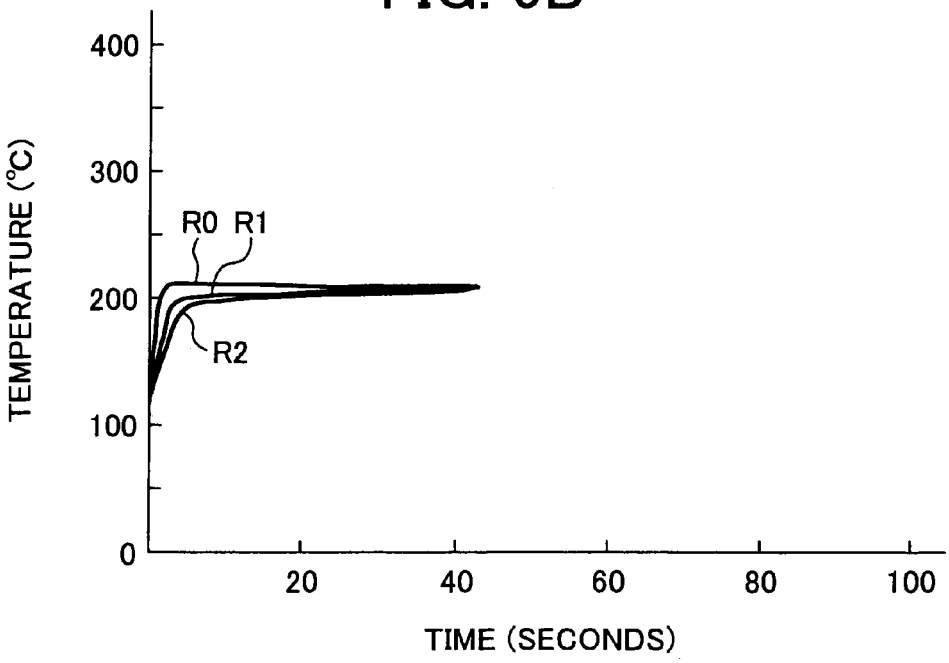
Figure 10A:
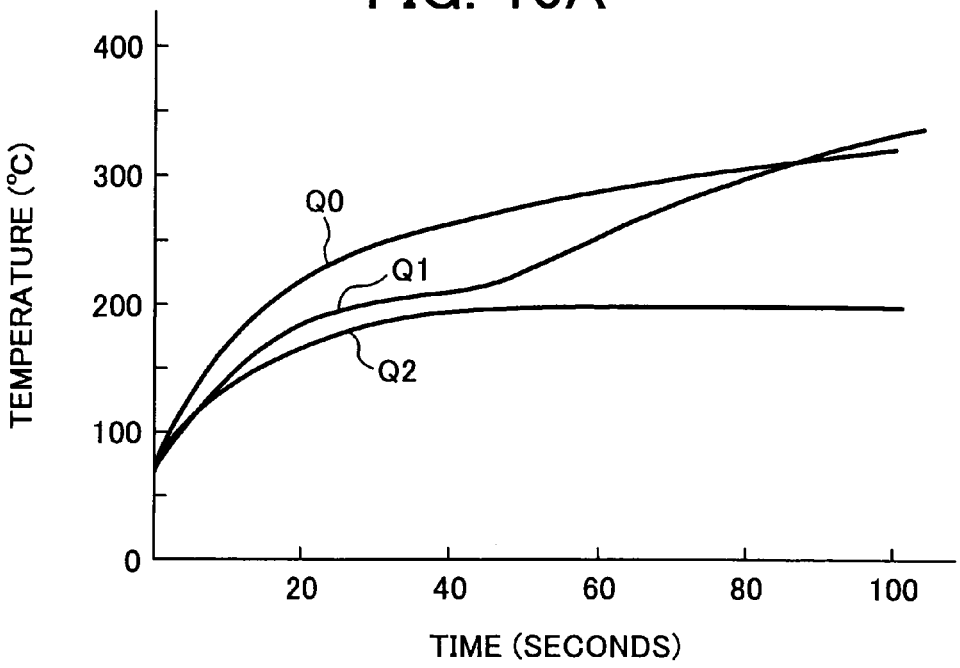
FIGS. 10A and 10B are graphs illustrating experimental results obtained by using the experimental devices of FIGS. 7B and 8B.
Figure 10B:
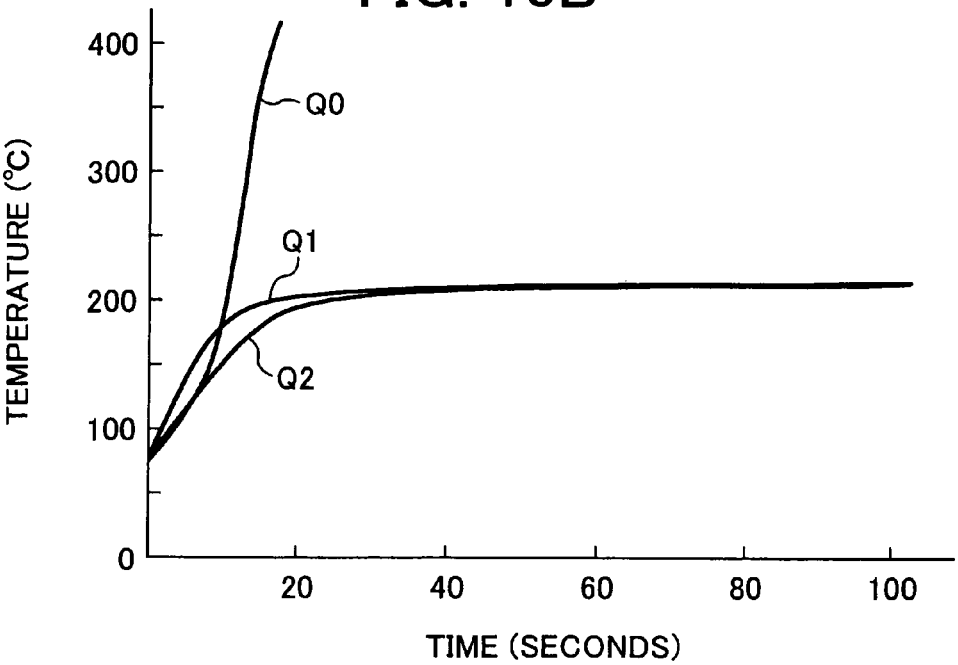

FIGS. 9A and 9B illustrate results of experiments performed by using the experimental devices 70*a* and 80*a*. FIGS. 10A and 10B illustrate results of experiments performed by using the experimental devices 70*b* and 80*b*. Horizontal axes represent a time elapsed after induction heating starts. Vertical axes represent a surface temperature of the heat generating layer 33.

FIG. 9A illustrates a relationship between the time and the temperature when the high-frequency power source 40 applies an alternating current having a frequency of 36 kHz. FIG. 9B illustrates a relationship between the time and the temperature when the high-frequency power source 40 applies an alternating current having a frequency of 130 kHz. In FIGS. 9A and 9B, solid lines R0 represent results of experiments performed by using the experimental device 80*a*. Solid lines R1 represent results of experiments performed by using the experimental device 70*a* including the conductive layer 34 having the thickness of 0.3 mm. Solid lines R2 represent results of experiments performed by using the experimental device 70*a* including the conductive layer 34 having the thickness of 0.8 mm.

FIG. 10A illustrates a relationship between the time and the temperature when the high-frequency power source 40 applies an alternating current having the frequency of 36 kHz. FIG. 10B illustrates a relationship between the time and the temperature when the high-frequency power source 40 applies an alternating current having the frequency of 130 kHz. In FIGS. 10A and 10B, solid lines Q0 represent results of experiments performed by using the experimental device 80*b*. Solid lines Q1 represent results of experiments performed by using the experimental device 70*b* including the conductive layer 34 having the thickness of 0.3 mm. Solid lines Q2 represent results of experiments performed by using the experimental device 70*b* including the conductive layer 34 having the thickness of 0.8 mm.

The experimental results shown in FIGS. 9A and 9B reveal that the temperature of the heat generating layer 33 does not overly increase after the temperature of the heat generating layer 33 reaches the Curie point, regardless of whether the test pieces 32*a* and 33*a* include the conductive layer 34 or not or whether the frequency of the alternating current is 36 kHz or 130 kHz. The experimental results shown in FIG. 10A reveal that the temperature of the heat generating layer 33 overly increases unless the conductive layer 34 has the thickness of 0.8 mm or more when the alternating current has the frequency of 36 kHz. The experimental results shown in FIG. 10B reveal that the temperature of the heat generating layer 33 overly increases unless the conductive layer 34 has the thickness of 0.3 mm or more when the alternating current has the frequency of 130 kHz. Thus, when the coil 25 faces the front surface of the heat generating layer 33 only, it is necessary to arrange the conductive layer 34, which is nonmagnetic and has a low resistance, on the back surface of the heat generating layer 33.

The above experimental results reveal that the heat generating layer 33 effectively heats itself and controls its temperature when the coil 25 having the loop-like shape sandwiches the heat generating layer 33. The effects can be obtained even when the conductive layer 34 is not provided. Therefore, the heat generating layer 33 can be simplified and produced at a low cost. Because it is not necessary to arrange the conductive layer 34 on the back surface of the heat generating layer 33, a problematic separation of the conductive layer 34 from the heat generating layer 33 does not occur.

Figure 11:
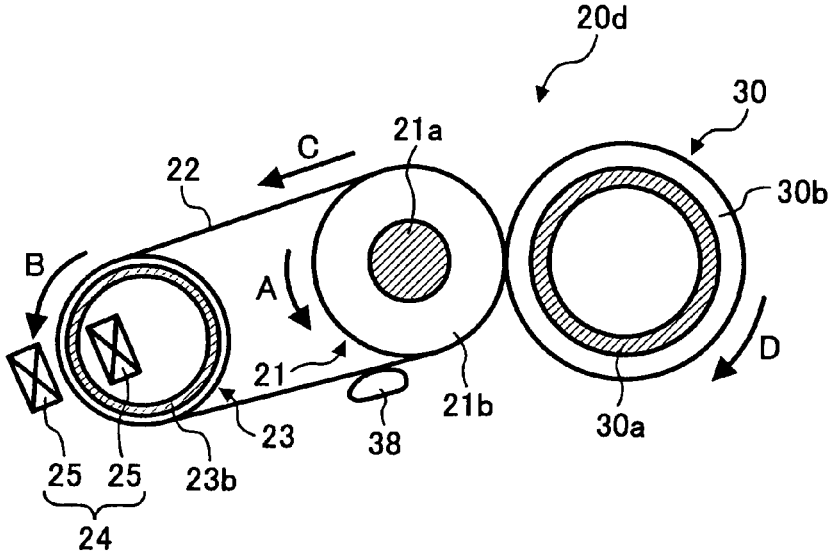
FIG. 11 is a cross-sectional view of a fixing unit according to another exemplary embodiment of the present invention.

Referring to FIG. 11, another exemplary embodiment of the present invention is explained. A fixing unit 20*d* has a structure of the fixing unit 20*a*, but is not driven for a predetermined time period after the high-frequency power source 40 is turned on. The fixing unit 20*d* is configured to fix a toner image on the recording sheet P.

As illustrated in FIG. 11, the coil 25 sandwiches different areas on the outer circumferential surface of the support roller 23 via the fixing belt 22 and the inner circumferential surface of the support roller 23, as the fixing belt 22 and the support roller 23 rotate. Specifically, a driver (not shown) drives the auxiliary fixing roller 21 to rotate in the rotating direction A. The fixing belt 22 rotates in the rotating direction C. The support roller 23 rotates in the rotating direction B.

According to the present embodiment, the auxiliary fixing roller 21 does not rotate immediately after the high-frequency power source 40 is turned on. The auxiliary fixing roller 21 starts rotating when the predetermined time period elapses after the high-frequency power source 40 is turned on. When the high-frequency power source 40 is turned on, the high-frequency power source 40 applies an alternating current to the coil 25. The coil 25 starts generating a magnetic flux. The magnetic flux induces Joule heat in the heat generating layers 22*b* and 23*b*. While the fixing belt 22 and the support roller 23 stop rotating, the Joule heat heats the fixing belt 22 and the support roller 23 for the predetermined time period. When the surface temperature of the fixing belt 22 reaches the fixing temperature, the fixing belt 22 and the support roller 23 start rotating.

Figure 12:
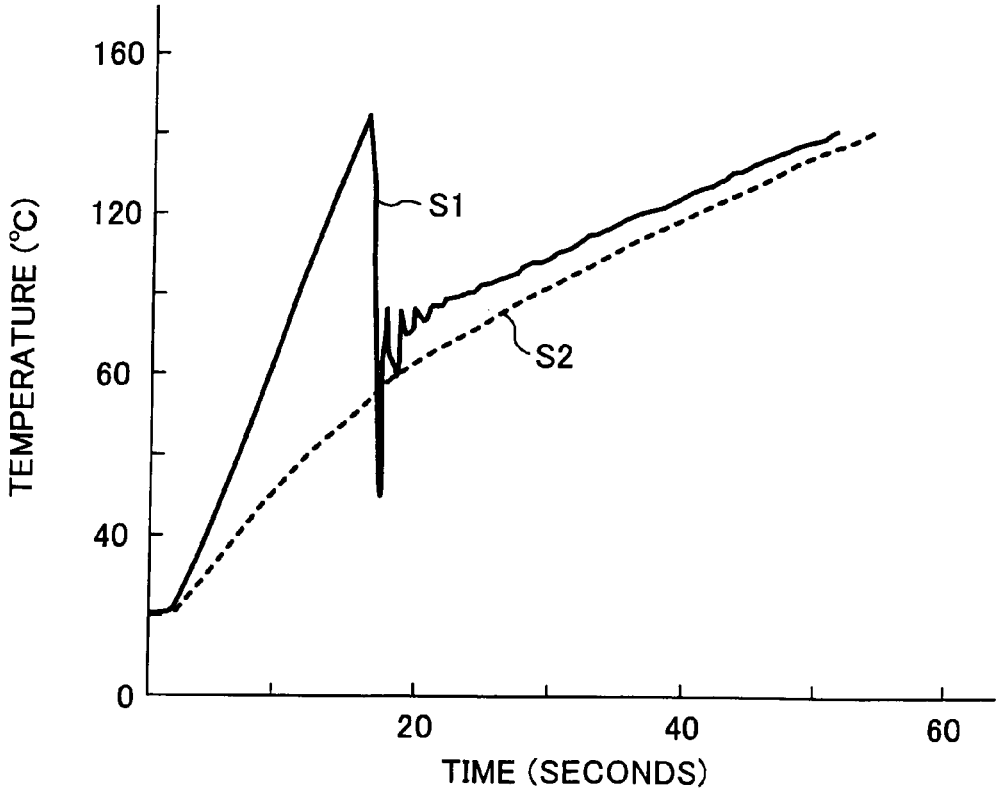
FIG. 12 is a graph illustrating changes in a surface temperature of a fixing belt of the fixing unit shown in FIG. 11.

FIG. 12 illustrates changes in the surface temperature of the fixing belt 22. In FIG. 12, a horizontal axis represents a time elapsed after the high-frequency power source 40 is turned on. A vertical axis represents the surface temperature of the fixing belt 22. A solid line S1 represents changes in the surface temperature of the fixing belt 22 in a case where the fixing belt 22 and the support roller 23 start rotating when the predetermined time period elapses after the high-frequency power source 40 is turned on. The predetermined time period is equivalent to a time period required for the surface temperature of the fixing belt 22 to reach a target fixing temperature (i.e., 140 degrees centigrade) after the high-frequency power source 40 is turned on. A broken line S2 represents changes in the surface temperature of the fixing belt 22 in a case where the fixing belt 22 and the support roller 23 start rotating immediately after the high-frequency power source 40 is turned on.

The solid line S1 and the broken line S2 represent that the surface temperature of the fixing belt 22 reaches the target fixing temperature in a shorter time period in the case where the fixing belt 22 and the support roller 23 start rotating when the predetermined time period elapses after the high-frequency power source 40 is turned on than in the case where the fixing belt 22 and the support roller 23 start rotating immediately after the high-frequency power source 40 is turned on. The time period required for the surface temperature of the fixing belt 22 to reach the target fixing temperature can be adjusted by changing shapes of parts of the fixing unit 20*d*, heat capacity variable depending on materials, and electric power applied.

The fixing belt 22 and the support roller 23 can start rotating when the predetermined time period elapses after the high-frequency power source 40 is turned on, in the fixing unit 20*d* capable of effectively controlling its temperature. If the fixing unit 20*d* cannot effectively control its temperature, the fixing belt 22 and the support roller 23 need to start rotating immediately after the high-frequency power source 40 is turned on, because the surface temperature of the fixing belt 22 overly increases while the fixing belt 22 and the support roller 23 stop rotating after the high-frequency power source 40 is turned on.

As described above, according to the present embodiment, the surface temperature of the fixing belt 22 can reach the target fixing temperature in a shorter time period in the case where the fixing belt 22 and the support roller 23 start rotating when the predetermined time period elapses after the high-frequency power source 40 is turned on than in the case where the fixing belt 22 and the support roller 23 start rotating immediately after the high-frequency power source 40 is turned on. Thus, the fixing unit 20*d* can reduce energy consumption.

Figure 13:
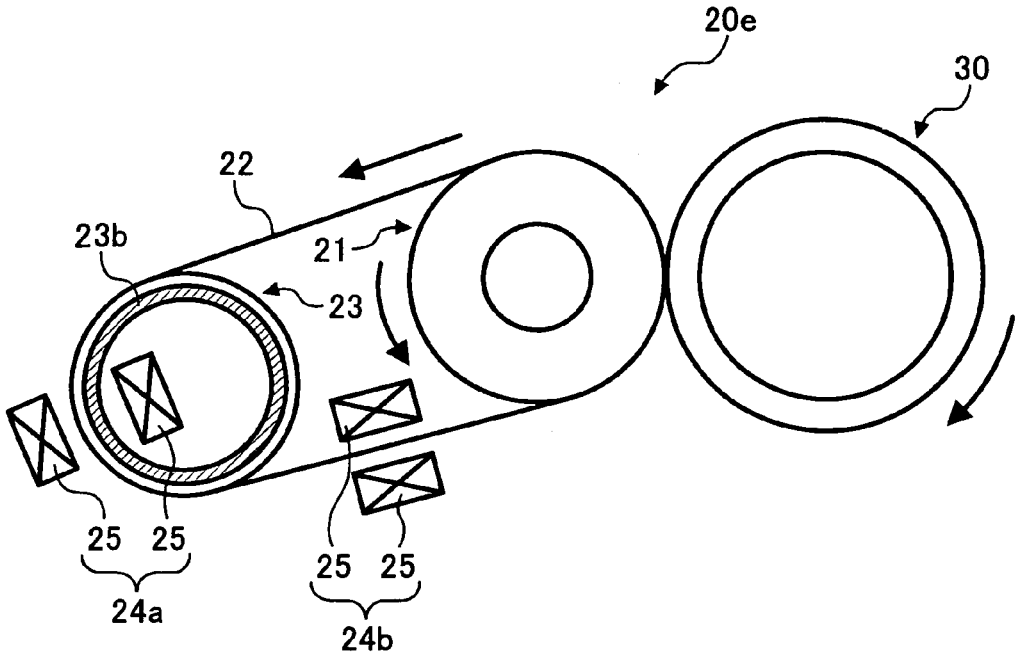
FIG. 13 a cross-sectional view of a fixing unit according to another exemplary embodiment of the present invention.
Figure 14:
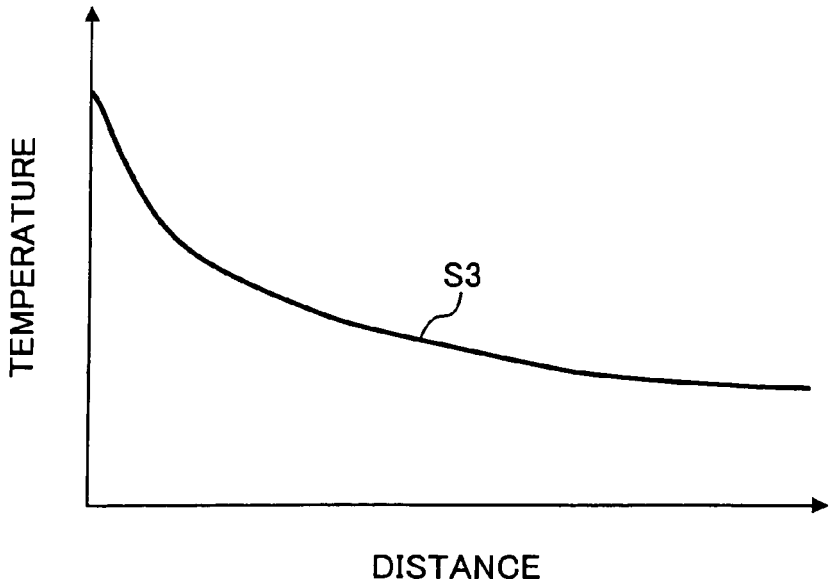
FIG. 14 is a graph illustrating a temperature gradient of a surface of a fixing belt of the fixing unit shown in FIG. 13.

Referring to FIGS. 13 and 14, another exemplary embodiment of the present invention is explained.

A fixing unit 20*e* illustrated in FIG. 13 and the fixing unit 20*a* illustrated in FIG. 2 have a common structure. However, the fixing unit 20*e* includes two induction heaters 24*a* and 24*b*. The heat generating layers 22*b* and 23*b* have different Curie points.

The fixing unit 20*e* is configured to fix a toner image on the recording sheet P.

According to the present embodiment, the heat generating layers 22*b* and 23*b* are used as the heat generating layers. The fixing belt 22 is used as a second heat generator including the heat generating layer. The support roller 23 is used as a first heat generator including the heat generating layer. The fixing belt 22 is used as the fixing member.

A Curie point of the heat generating layer 22*b* is set to be higher than a Curie point of the heat generating layer 23*b*. Specifically, the Curie point of the heat generating layer 23*b* is set to be near a target fixing temperature (i.e., a surface temperature of the fixing belt 22 enabling stable fixing, for example, 180 degrees centigrade). The Curie point of the heat generating layer 22*b* is set to be sufficiently higher than the target fixing temperature. The Curie points can be adjusted by changing metallic materials or magnetic shunt alloys used in the heat generating layers 22*b* and 23*b*.

Heat induced by the induction heater 24*a* heats the fixing belt 22 and the support roller 23. Heat induced by the induction heater 24*b* heats the fixing belt 22 only. A thermistor (not shown) detects the surface temperature of the fixing belt 22. When the surface temperature of the fixing belt 22 reaches the target fixing temperature, supply of electric power to the induction heater 24*b* stops and electric power is supplied to the induction heater 24*a* only. The Curie point of the heat generating layer 23*b* is set to be near the target fixing temperature. Thus, the Curie point of the heat generating layer 23*b* functions as a limiter for preventing the surface temperature of the fixing belt 22 from overly increasing.

As described above, according to the present embodiment, the fixing unit 20*e* includes the heat generating layers 22*b* and 23*b* having the different Curie points. The surface temperature of the fixing belt 22 can reach the target fixing temperature in a short time period. The fixing unit 20*e* can also prevent the surface temperature of the fixing belt 22 from overly increasing.

FIG. 14 illustrates a temperature gradient of the surface of the fixing belt 22. A horizontal axis represents a distance between the heat generating layer 22 and the surface of the fixing belt 22. A vertical axis represents the surface temperature of the fixing belt 22. The fixing belt 22 has multiple layers generating a temperature gradient S3. The heat generating layer 22*b* generates a certain amount of heat for a predetermined time period. The longer the distance between the heat generating layer 22*b* and the surface of the fixing belt 22 is, the lower the surface temperature of the fixing belt 22 is. The temperature gradient S3 varies depending on thermal conductivity and specific heat of the base layer 22*a*, the heat generating layer 22*b*, the elastic layer 22*c*, and the releasing layer 22*d*, and heat radiation to surrounding parts and the recording sheets P. When amounts of heat generated and radiated (or diffused) are balanced, the Curie point of the heat generating layer 22*b* can be determined based on the temperature gradient S3 only.

The amounts of heat generated and radiated are not balanced soon after the high-frequency power source 40 is turned on. In this case, the Curie point of the heat generating layer 22*b* cannot be determined based on the temperature gradient S3 only. Namely, the surrounding parts including the pressure roller 30 and the auxiliary fixing roller 21 have low temperatures and draw a substantial amount of heat from the fixing belt 22. Thus, the amounts of heat generated and radiated are not balanced. In a low-speed image forming apparatus (i.e., a small-size image forming apparatus), the surrounding parts have relatively small heat capacity. Therefore, the amounts of heat generated and radiated are balanced in a short time period. In a high-speed image forming apparatus (i.e., a large-size image forming apparatus), the surrounding parts have large heat capacity. Therefore, it takes a longer time period before the amounts of heat generated and radiated are balanced in the large-size image forming apparatus than in the small-size image forming apparatus.

According to the present embodiment, the Curie point of the heat generating layer 22*b* is set to be sufficiently higher than the target fixing temperature. An increased amount of heat is supplied to the surrounding parts when the high-frequency power source 40 is turned on. Thus, the surface temperature of the fixing belt 22 reaches the target fixing temperature in a short time period. It is preferable that the fixing belt 22 having the high Curie point intensely supplies heat to the surrounding parts after the high-frequency power source 40 is turned on and before the surface temperature of the fixing belt 22 reaches the target fixing temperature. The Curie point of the heat generating layer 22*b* before the surface temperature of the fixing belt 22 reaches the target fixing temperature (i.e., before the amounts of heat generated and radiated are balanced) is set to be higher than the Curie point after the surface temperature of the fixing belt 22 reaches the target fixing temperature (i.e., after the amounts of heat generated and radiated are balanced). Thus, the surface temperature of the fixing belt 22 can reach the target fixing temperature in a short time period. The fixing unit 20*e* can also prevent the surface temperature of the fixing belt 22 from overly increasing.

Further, the Curie point of the heat generating layer 23*b* is set to be near the target fixing temperature based on the temperature gradient S3. The Curie point of the heat generating layer 22*b* is set in a range of 200 to 300 degrees centigrade based on heat resistances of the base layer 22*a* and the elastic layer 22*c*.

Thus, the surface temperature of the fixing belt 22 can reach the target fixing temperature in a short time period. The fixing unit 20*e* can also prevent the surface temperature of the fixing belt 22 from overly increasing.

Figure 15:
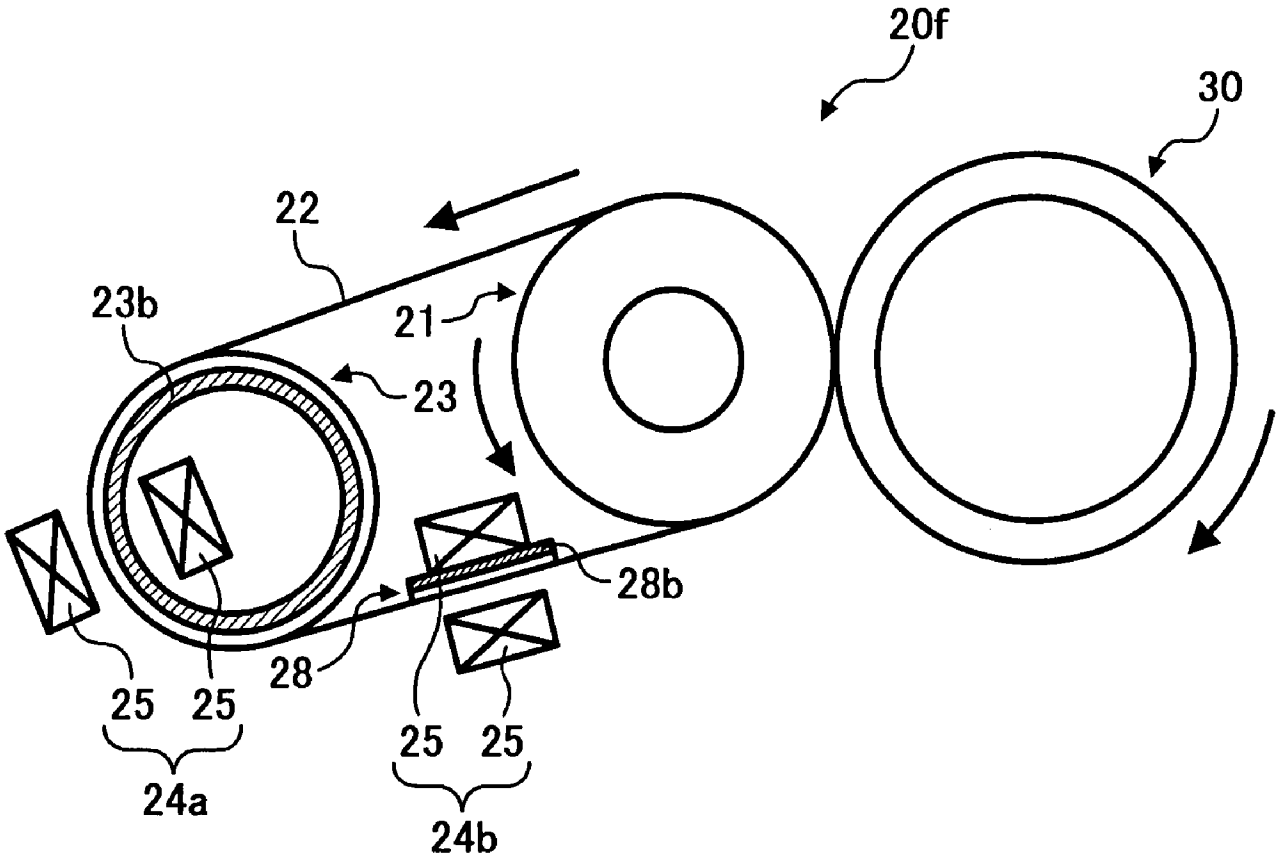
FIG. 15 is a cross-sectional view of a fixing unit according to another exemplary embodiment of the present invention.

Referring to FIG. 15, another exemplary embodiment of the present invention is explained.

A fixing unit 20*f* has a structure similar to the structure of the fixing unit 20*e*. In the fixing unit 20*f*, however, the fixing belt 22 does not include the heat generating layer 22*b*. Therefore, the coil 25 of the induction heater 24*a* causes the heat generating layer 23*b* to generate heat. The coil 25 of the induction heater 24*b* causes the heat generating layer 28*b* to generate heat.

The fixing unit 20*f* is configured to fix a toner image on the recording sheet P.

According to the present embodiment, the support roller 23 and the heat generating plate 28 are used as the heaters. The heat generating layers 23*b* and 28*b* are used as the heat generating layers. The support roller 23 is used as the first heat generator. The heat generating plate 28 is used as the second heat generator. The fixing belt 22 is used as the fixing member. The coil 25 of the induction heater 24*a* is used as a first coil for generating a magnetic flux. The coil 25 of the induction heater 24*b* is used as a second coil for generating a magnetic flux.

A Curie point of the heat generating layer 28*b* is set to be higher than the Curie point of the heat generating layer 23*b*. Specifically, the Curie point of the heat generating layer 23*b* is set to be near the target fixing temperature. The Curie point of the heat generating layer 28*b* is set to be sufficiently higher than the target fixing temperature.

The coil 25 of the induction heater 24*a* sandwiches the support roller 23 in the manner that the coil 25 faces the outer circumferential surface of the support roller 23 via the fixing belt 22 and the inner circumferential surface of the support roller 23. The coil 25 of the induction heater 24*a* causes the heat generating layer 23*b* to generate heat. The coil 25 of the induction heater 24*b* sandwiches the heat generating plate 28 in the manner that the coil 25 faces the outer circumferential surface of the heat generating plate 28 via the fixing belt 22 and the inner circumferential surface of the heat generating plate 28. The coil 25 of the induction heater 24*b* causes the heat generating layer 28*b* to generate heat.

An alternating current is applied to the coil 25 of the induction heater 24*b* only before the surface temperature of the fixing belt 22 reaches the target fixing temperature. An alternating current is applied to the coil 25 of the induction heater

24*a* only after the surface temperature of the fixing belt 22 reaches the target fixing temperature.

The coil 25, the support roller 23, and the heat generating plate 28 can be configured to have similar inductance, equivalent series resistance, and capacitance. In this case, a common power source (not shown) applies an alternating current to one of the induction heaters 24*a* and 24*b* at a time. Switching can control which to apply the alternating current to, the induction heater 24*a* or 24*b*.

Thus, the surface temperature of the fixing belt 22 can reach the target fixing temperature in a short time period. The fixing unit 20*f* can also prevent the surface temperature of the fixing belt 22 from overly increasing.

The present invention has been described above with reference to specific embodiments. Note that the present invention is not limited to the details of the embodiments described above, but various modifications and improvements are possible without departing from the spirit and scope of the invention. It is therefore to be understood that within the scope of the appended claims, the present invention may be practiced otherwise than as specifically described herein. For example, elements and/or features of different illustrative embodiments may be combined with each other and/or substituted for each other within the scope of the present invention and appended claims.

What is claimed is:

1. An image forming apparatus, comprising:

an image forming unit configured to form a toner image on a recording sheet; and a fixing unit configured to fix the toner image on the recording sheet, the fixing unit comprising, a coil configured to receive a current to generate a magnetic flux, and a heat generator having inner and outer circumferential surfaces, wherein the coil faces the inner and outer circumferential surfaces of the heat generator that is configured to generate heat from the magnetic flux generated by the coil.

2. The image forming apparatus according to claim 1, wherein the coil includes at least one wire.

3. The image forming apparatus according to claim 1, wherein the coil is formed in a substantially U shape having two outer portions separated by a curved portion.

4. The image forming apparatus according to claim 1, wherein the coil is formed in a substantially U shape and the heat generator is placed in a gap of the coil.

5. The image forming apparatus according to claim 1, wherein the coil is formed in a substantially loop shape having two outer segments separated by a curved segment.

6. The image forming apparatus according to claim 1, wherein the coil is formed in a loop shape and the heat generator is placed inside a loop of the coil.

7. The image forming apparatus according to claim 1, wherein the coil is configured to receive an alternating current as the current.

8. The image forming apparatus-according to claim 1, wherein the heat generator comprises a heat generating layer having a Curie point not greater than 300 degrees centigrade.

9. The image forming apparatus according to claim 1, wherein the heat generator comprises a heat generating layer including a magnetic shunt alloy.

10. The image forming apparatus according to claim 1, wherein the fixing unit includes a fixing member configured to receive heat from a separate heat generator or to include the heat generator as a part of the fixing member and to transfer received heat to melt the toner image.

11. The image forming apparatus according to claim 10, wherein the fixing member is formed in a belt shape and is extended in an endless loop form and the coil is arranged at a position to face outer and inner circumferential surfaces of the fixing member.

12. The image forming apparatus according to claim 11, further comprising:

a pressure roller configured to apply pressure to the recording sheet conveyed;

a support roller configured to support the fixing member at one end of the endless loop form; and an auxiliary fixing roller configured to support the fixing member at another end of the endless loop form and to receive the pressure from the pressure roller via the recording sheet and the fixing member.

13. The image forming apparatus according to claim 12, wherein the coil is arranged at a position facing an inner circumferential surface of the fixing member via the support roller.

14. The image forming apparatus according to claim 10, further comprising:

a pressure roller configured to apply pressure to the recording sheet conveyed, wherein the fixing member has a roller shape and contacts the pressure roller, and wherein the coil is arranged at a position facing outer and inner circumferential surfaces of the fixing member.

15. The image forming apparatus according to claim 10, wherein the heat generator includes a heater configured to apply heat to the fixing member.

16. The image forming apparatus according to claim 11, further comprising:

a pressure roller configured to apply pressure to the recording sheet conveyed; and an auxiliary fixing roller configured to support the fixing member at one end of the endless loop form and to receive the pressure from the pressure roller via the recording sheet and the fixing member, wherein the heat generator includes a heating roller configured to support the fixing member at another end of the endless loop form and to apply heat to the fixing member.

17. The image forming apparatus according to claim 11, wherein the fixing member is configured to be rotated and the coil is configured to sequentially face different areas of the outer and inner circumferential surfaces of the fixing member when the fixing member is rotated, and the fixing member is not rotated until a predetermined time period after the coil receives said current to generate the magnetic flux.

18. The image forming apparatus according to claim 17, wherein the predetermined time period is the time it takes the fixing member to be heated to a predetermined temperature.

19. The image forming apparatus according to claim 1, further comprising:

at least one supplemental heat generator configured to generate heat.

20. The image forming apparatus according to claim 12, wherein the support roller includes the heat generator configured to heat the fixing member and a supplemental heat generating plate is configured to also heat the fixing member.

21. The image forming apparatus according to claim 12, wherein the support roller includes a supplemental heat generator and the fixing member includes a heat generating layer as the heat generator.

22. The image forming apparatus according to claim 21, wherein the heat generating layer of the fixing member is configured to have a Curie point higher than that of the supplemental heat generator.

23. The image forming apparatus according to claim 21, wherein the Curie point of the heat generating layer of the fixing member is higher than a target fixing temperature.

24. The image forming apparatus according to claim 21, wherein the Curie point of the supplemental heat generator of the support roller is close to a target fixing temperature.

25. The image forming apparatus according to claim 21, further comprising:

a supplemental coil configured to supplementally environ the outer and inner circumferential surfaces of the fixing member and to be controlled to generate a magnetic flux during a power-on time of the apparatus.

26. The image forming apparatus according to claim 25, wherein the supplemental heat generator is configured to be controlled to generate a magnetic flux after the power-on time of the apparatus.

27. An image forming apparatus, comprising:

means for forming a toner image on a recording sheet; and means for fixing the toner image on the recording sheet, the means for fixing comprising, means for creating a magnetic, and means for generating heat from the magnetic flux created by the means for creating, the means for generating heat having inner and outer circumferential surfaces and the means for creating faces the inner and outer circumferential surfaces.

28. The image forming apparatus according to claim 27, wherein the means for creating includes at least one wire.

29. The image forming apparatus according to claim 27, wherein the means for creating is formed in a substantially U shape having two outer portions separated by a curved portion.

30. The image forming apparatus according to claim 27, wherein the means for creating is formed in a substantially U shape and the heat generating means is placed in a gap of the means for creating.

31. The image forming apparatus according to claim 27, wherein the means for creating is formed in a substantially loop shape having two outer segments separated by a curved segment.

32. An image forming method, comprising:

forming a toner image on a recording sheet; and fixing the toner image on the recording sheet, the fixing comprising, creating a magnetic flux by applying an alternating current to a coil facing inner and outer surfaces of a heat generators, receiving the magnetic flux at the heat generator and generating heat there from to heat an associated fixing element to a predetermined temperature, and fixing the toner image on the recording sheet using the fixing element.

33. The method according to claim 32, wherein the coil includes at least one wire.

34. The method according to claim 32, wherein the coil is formed in a substantially U shape having two outer portions separated by a curved portion.

35. The method according to claim 32, wherein the coil is formed in a substantially loop shape having two outer segments separated by a curved segment.

36. A fixing unit configured to fix a toner image on a recording sheet, comprising:

a coil configured to receive a current to generate a magnetic flux, and a heat generator having inner and outer circumferential surfaces, wherein the coil faces the inner and outer circumferential surfaces, and wherein the heat generator is configured to generate heat by the magnetic flux generated by the coil.

37. The fixing unit according to claim 36, wherein the coil includes at least one wire.

38. The fixing unit according to claim 36, wherein the coil is formed in a substantially U shape having two outer legs separated by a curved portion.

39. The fixing unit according to claim 36, wherein the coil is formed in a substantially U shape and the heat generator is placed in a gap of the coil.

40. The fixing unit according to claim 36, wherein the coil is formed in a substantially loop shape having two outer segments separated by a curved segment.

41. The fixing unit according to claim 36, wherein the coil is formed in a loop shape and the heat generator is placed inside a loop of the coil.

42. An image forming apparatus, comprising:

an image forming unit configured to form a toner image on a recording sheet; and a fixing unit configured to fix the toner image on the recording sheet, the fixing unit comprising:

a magnetic flux generator including an exciting coil configured to generate a magnetic flux; and a heater configured to generate heat by the magnetic flux, wherein the exciting coil is disposed to surround an inner surface of the heater and an outer surface of the heater.

43. The image forming apparatus according to claim 42, wherein the heater includes a magnetic conductive layer and a conductive layer, and the magnetic conductive layer has a Curie point not greater than 300 degrees centigrade.

44. The image forming apparatus according to claim 42, wherein the heater is formed in a roller or a belt.

45. An image forming apparatus, comprising:

an image forming unit configured to form a toner image on a recording sheet; and a fixing unit configured to fix the toner image on the recording sheet, the fixing unit comprising:

a magnetic flux generator including an exciting coil configured to generate a magnetic flux and a heater configured to generate heat by the magnetic flux wherein the exciting coil is disposed to surround an inner surface of the heater and an outer surface of the heater, and wherein the heater has a Curie point not greater than 300 degrees centigrade.

46. The image forming apparatus according to claim 45, wherein the heater is formed in a roller or a belt.

47. The image forming apparatus according to claim 45, wherein the heater has a Curie point not lower than a fixing temperature.

48. An image forming apparatus, comprising:

an image forming unit configured to form a toner image on a recording sheet; and a fixing unit configured to fix the toner image on the recording sheet, the fixing unit comprising:

an induction heater configured to generate a magnetic field; and a heater configured to generate heat when placed in the magnetic filed, the induction heater comprising:

an exciting coil; and a high frequency power source configured to apply a current to the exciting coil, wherein the heater has a Curie point not greater than 300 degrees centigrade, and wherein the heater starts rotating when a predetermined time period elapses after the high frequency power source is turned on, and the exciting coil is disposed to surround an inner surface of the heater and an outer surface of the heater.

49. The image forming apparatus according to claim 48, wherein the heater is formed in a roller or a belt.

* * * * *

UNITED STATES PATENT AND TRADEMARK OFFICE

CERTIFICATE OF CORRECTION

PATENT NO. : 7,480,478 B2
APPLICATION NO. : 11/167845
DATED : January 20, 2009
INVENTOR(S) : Aze et al.

It is certified that error appears in the above-identified patent and that said Letters Patent is hereby corrected as shown below:

Column 17, Line 57: Replace “apparatus-according” with --apparatus according--

Column 19, Line 25: Insert --flux-- after “magnetic”

Column 19, Line 52: Replace “generators” with --generator--

Column 20, Line 65: Replace “filed” with --field--

Signed and Sealed this

Fifth Day of May, 2009

John Doll

JOHN DOLL
*Acting Director of the United States Patent and Trademark Office*